US008272533B1

(12) United States Patent
D'Amelia et al.

(10) Patent No.: US 8,272,533 B1
(45) Date of Patent: Sep. 25, 2012

(54) NO TOUCH UTENSIL DISPENSER

(76) Inventors: Anthony D'Amelia, Binghamton, NY (US); Mark V. Pierson, Binghamton, NY (US)

( * ) Notice: Subject to any disclaimer, the term of this patent is extended or adjusted under 35 U.S.C. 154(b) by 201 days.

(21) Appl. No.: 12/831,396

(22) Filed: Jul. 7, 2010

(51) Int. Cl.
*B65H 3/00* (2006.01)

(52) U.S. Cl. ..... 221/197; 221/195; 221/250; 221/172

(58) Field of Classification Search ..... 221/22, 221/27, 28, 29, 172, 178, 191, 194, 195, 221/247, 250, 309
See application file for complete search history.

(56) References Cited

U.S. PATENT DOCUMENTS 2,141,684 A * 12/1938 Diemer ..... 221/239
2,149,099 A * 2/1939 Phinney et al. ..... 221/6
2,911,127 A * 11/1959 Driss et al. ..... 221/258
4,134,519 A * 1/1979 Barnett et al. ..... 221/46
5,131,562 A * 7/1992 Brown ..... 221/41
6,250,498 B1 * 6/2001 Lovejoy ..... 221/185
6,336,568 B1 * 1/2002 Tucker et al. ..... 221/131
6,832,694 B2 * 12/2004 Goeking et al. ..... 221/195
D584,084 S 1/2009 Tucker
7,669,732 B2 * 3/2010 Njaastad ..... 221/255
7,900,797 B1 * 3/2011 Witcraft ..... 221/251
2007/0108141 A1 5/2007 Smith et al.
2010/0170915 A1 7/2010 Reinsel et al.

* cited by examiner

*Primary Examiner* — Patrick Mackey
(74) *Attorney, Agent, or Firm* — Mark Levy; Hinman, Howard & Kattell, LLP

(57) ABSTRACT

A device for dispensing cutlery utensils individually, having a housing containing a quantity of utensils with the housing having sides and product guides within. The front wall contains an opposing leaf escapement mechanism connected to it, to hold and singulate the utensils such that they dispense seriatim, without a user being required to physically touch or interface with any part of dispenser other than the actual desired utensil.

10 Claims, 5 Drawing Sheets

NO TOUCH UTENSIL DISPENSER

FIELD OF THE INVENTION

The invention pertains to a system and method of dispensing recyclable cutlery utensils and, more particularly, to a system and method that dispenses these utensils hygienically without users having to physically touch any part of a dispenser, other than the specific utensil they wish to dispense for their use.

BACKGROUND OF THE INVENTION

A convergence of factors, such as reduced antibiotic effectiveness coupled with an increasingly fast food directed environment, have combined to create a need for a new cutlery dispenser. The dispenser should have both the ability to dispense cutlery in a hygienic manner and also provides an inventory control means in that it allots only one utensil per actuation.

Disposable cutlery such plastic spoons, forks, knives, and Sporks® are normally used in casual restaurant settings and are provided by the eating establishment for use in the restaurant and with take-out food. To ensure that this cutlery is provided in a hygienic form, a purveyor often purchases bulk quantities of individual portions of cutlery each pre-sealed in a small bag. The bag may also contain a napkin, dry condiments, and a hand sanitizer wipe. Such bags are generally more expensive than the sum of individual utensils due to the processing and materials necessary to form the bags. Also, these bags may provide more items than the user requires, which is uneconomical.

An option to such prepackaged bags is the presentation of cutlery in a tray or cup positioned near the point of sale. This approach allows the customer to select only the utensils desired. However, this form of supply can be unsanitary and unhygienic if a customer does not take a utensil that is purposely touched or inadvertently brushed against while rummaging through the proffered selection to find the perfect spoon for soup, for example. Airborne pathogens may settle on exposed surfaces of the remaining cutlery. The unregulated dispensing of the cutlery also permits the customer to take more utensils than needed, thus resulting in a lower profit margin for the establishment.

It is an object of the present invention to provide a reliable, efficient system for fulfilling recyclable cutlery needs.

It is a further object of the present invention to provide a non-electric automatic cutlery fulfillment system that requires no power budget overhead and requires little involvement or oversight by the eating establishment.

It is another object of the present invention to broaden the scope of hygienic practices and ultimately provide a secure cutlery dispensing fulfillment system.

It is still another object of the present invention to provide a time limited inventory containment process to minimize undo cutlery dispensing for personal gain.

It is a further object of the invention to provide an improved method for dispensing cutlery in a controlled fashion.

It is further still another object of the present invention to provide stackable magazine sections to enlarge the capacity of the dispenser.

DISCUSSION OF RELATED ART

U.S. Pat. No. 4,134,519 for DISPENSER FOR ELONGATE THIN FLEXIBLE ARTICLES, by Barnett, et al, granted Jan. 16, 1979 discloses a dispenser for elongated thin flexible articles stacked within a cartridge package. The unit is made of a cartridge holder vertically positioned and having a front access door and interior projections whereby a cartridge may be placed in the holder with the door open and maintained in a predetermined vertical position within the holder after the door is closed. The cartridge is provided with an opening at its lower end. The holder is provided with an opening at its lower end shaped to prevent the removal of an article unless it is gripped and flexed to conform to the opening. For this purpose, the lowermost article within the holder is held in an inclined position with one end on a step projection at the bottom of the holder. An intermediate portion of the lowermost article engaging a holder projection into the lower holder opening which is disengaged when the lowermost article is gripped and flexed in a manner to conform to the shape of the holder opening to permit removal of the lowermost article only. Window openings in both the door and cartridge allow the remaining supply of articles to be viewed at the lower end of the cartridge within the holder.

U.S. Pat. No. 6,336,568 for CUTLERY UTENSIL DISPENSER, by Tucker, et al, granted Jan. 8, 2002 discloses apparatus for dispensing cutlery utensils one at a time upon hand operation of an externally accessible utensil delivery controller. The dispenser includes a housing having at least one interior compartment in communication with an exit opening. At least partially accommodable within the interior compartment is a stack of utensils within a cartridge capable of universally accommodating knives or forks or spoons and provided with a portal through which a single utensil can pass and wherein a dispensable utensil is situated. The portal is situated in a pathway aligned with the exit opening. The utensil delivery controller is an externally accessible hand operable ejector engageable with the dispensable utensil for ejecting the dispensable utensil from the portal of the cartridge and thereafter through the pathway to the exit opening for ultimate user retrieval.

U.S. Pat. No. 6,832,694 for DISPENSER FOR CUTLERY UTENSILS, by Goeking, et al, granted Dec. 21, 2004 discloses a utensil dispenser for dispensing a utensil. The dispenser includes a base, which defines at least one dispensing opening. At least one utensil is positioned on or adjacent to a top surface of the base. The dispenser includes a dispensing mechanism capable of moving the one utensil. The utensil is dispensed by the dispensing mechanism moving the utensil to fall through the dispensing opening.

United States Published Patent Application No. 2007/0108141 for DISPENSER FOR DISPOSABLE CUTLERY AND COMPONENTS THEREFOR, by Smith, et al, published May 17, 2007 describes a dispenser for disposable cutlery and also relates to banded packets of disposable cutlery that can be used in the dispenser, as well as other cutlery dispensers that do not use a cartridge therein.

U.S. Design Pat. No. D584,084 for REFILLABLE CUTLERY DISPENSER MAGAZINE, by Tucker, granted Jan. 6, 2009 discloses an ornamental design for a refillable cutlery dispenser magazine.

The previously outlined United States issued patents and published applications fail to adequately describe or disclose the present invention.

SUMMARY OF THE INVENTION

The present invention is directed to an automated mechanical system and method for performing cutlery fulfillment for an organization that wishes to replace unhygienic cutlery dispensing. A preferred embodiment of the present invention includes an escapement mechanism that is manually activated as a customer removes a utensil from a dispenser and a replacement utensil is gravitationally compelled to seek its lowest point at the outlet of the dispenser, and subsequently replace a dispensed article, ready for activation by the next customer.

BRIEF DESCRIPTION OF THE DRAWINGS

A complete understanding of the present invention may be obtained by reference to the accompanying drawings, when considered in conjunction with the subsequent, detailed description, in which.

For purposes of brevity and clarity, like components and elements of the apparatus of this invention will bear the same designations or numbering throughout the FIGURES.

DETAILED DESCRIPTION OF THE PREFERRED EMBODIMENT

The present invention relates to a system for dispensing various cutlery objects with a no-touch approach and a method of dispensing recyclable cutlery utensils. The system dispenses these utensils without users having to physically touch any part of a dispenser, other than the specific utensil they wish to dispense for use.

For a better understanding of the present invention, together with other and further objects, advantages and capabilities thereof, reference is made to the following disclosure and appended claims.

By the term "cutlery" or "utensil" as used herein is meant a recyclable polymeric or metallic product including one or more embodiments, such as a spoon, fork, knife, Spork, and other accoutrements of dining on a budget.

By the term "no touch" and "dispenser" as used herein is meant a device that distributes cutlery or utensils without the need for a person to touch anything other than the individual cutlery itself, and can be done with one hand and a minimum of effort or motion.

Figure 1:
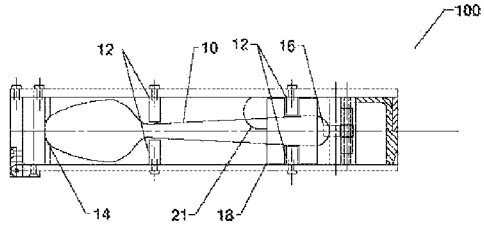
FIG. 1 is a top view of the no touch dispenser in accordance with the present invention.

Referring now to FIG. 1, there is shown a top view of a no touch dispenser 100 showing, in this embodiment, a spoon 10. Other cutlery items, such as forks, have similar boundary characteristics and subsequently are amenable to placement within the described invention with a minimum of alteration. In the described embodiment, the spoon 10 is constrained and aligned within guides 12 to ensure proper alignment and registration of the cutlery 10 to facilitate the proper sequencing and presentation of the individual cutlery items 10. At both ends of the spoon 10 are disposed respective stops, designated as distal stop 14 and escapement release protrusion 16. Escapement release protrusion 16 is described in more detail hereinbelow with respect to subsequent figures. Weight 18 enhances the ability of non-stackable cutlery to be retained and dispensed in an orderly fashion while not jamming dispenser with misguided utensils. Retention lead 21 allows weight 18 to descend inside the no touch dispenser 100 until such time as the cutlery 10 stock is depleted. At that time, retention lead 21 restrains the weight 18 from further descent into the exit area rest position 19 (FIG. 2.)

Figure 2:
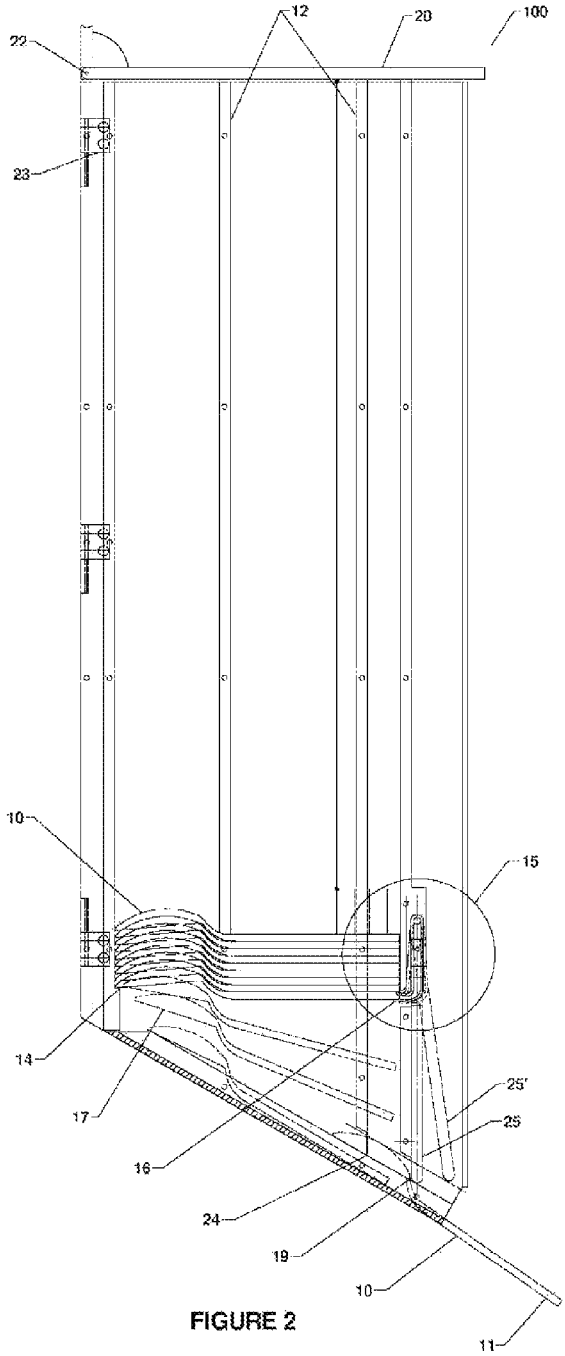
FIG. 2 is a side view of the no touch dispenser.

Referring to FIG. 2, there is shown a side view of no touch dispenser 100 with a top cover 20 attached to the body of the dispenser 100 via a hinge 22 to allow the refilling of cutlery 10 without having to remove the dispenser 100 from its support structure, not shown. Such support structure may include a planar surface of a restaurant or a rotating collection of various cutlery dispensers that allow for the selection of eating supplies. Hinge 23 allows an operator to open a side of dispenser 100 to clear any utensils 10 from the interior of the unit 100. A second embodiment of the current invention utilizes stackable magazine sections, not shown, that would allow the proprietor of the eating establishment to increase the cutlery capacity of the dispenser 100 by adding additional height to the dispenser. The stackable magazine section would have similar internal guide 12 structures to facilitate alignment and assembly ease of use.

This figure also shows a more detailed view of alignment guides 12 that work collectively to keep the cutlery 10 in a proper array for dispensing. When an item 10 is desired from the dispenser 100, a user, not shown, grasps item 10 in a location near the proximal end 11 and removes the item in a linear motion along the major axis of the cutlery 10 from exit area rest position 19.

Continuing with FIG. 2, the movement of cutlery 10 causes an escapement actuator finger 26 to move from a rest position 25 to an extended position 25', thereby retracting escapement release protrusion 16 from its position opposite distal stop 14 and releasing the next replacement utensil 10 that is gravitationally compelled to seek a point of lowest energy. This release action exposes proximal end 11 of the next utensil 10 to the outside environment of the eatery for the next customer. The dotted lines denote the motion of the utensil 10 after the retracting of escapement release protrusion 16 causes a momentary cantilever action 17. Distal stop 14 constrains the motion of the utensil 10 until the falling center of gravity pulls the utensil 10 from the distal stop 14. Utensil 10 is guided to the exit area rest position 19 by flexible wires 24. The flexible wires 24 also support and guide the utensil 10 when the exiting utensil 10 is not removed quick enough from dispenser 100 to allow the next utensil 10 to fill the exit area rest position 19 space.

Figure 3:
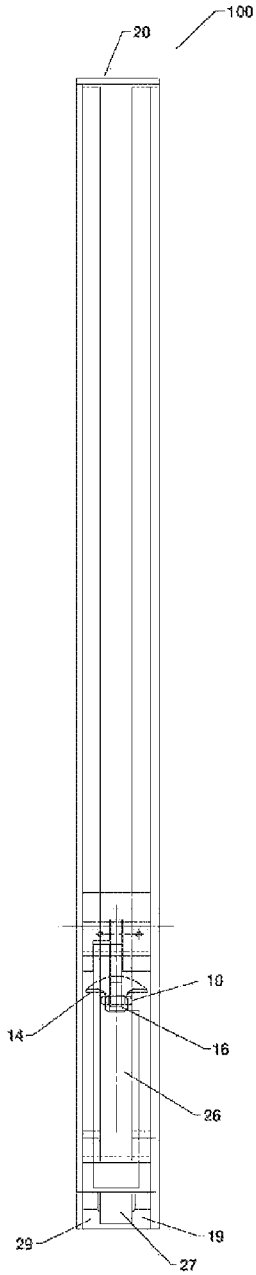
FIG. 3 is an end view of the no touch dispenser.

FIG. 3 shows a front view of dispenser 100 much as a customer would see it, albeit without a utensil 10 (FIG. 2) in the exit area rest position 19. Also shown is groove 27 in the bottom slide guide 29 that handle 10 of the falling bottom utensil drops into and slides downward until the utensil 10 stops on escapement finger 26

Figure 4:
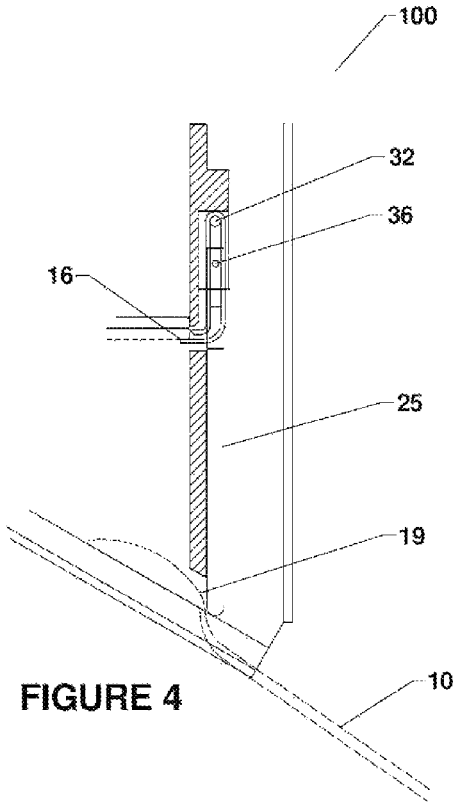
FIG. 4 is a detail at rest view of the no touch dispenser.
Figure 4A:
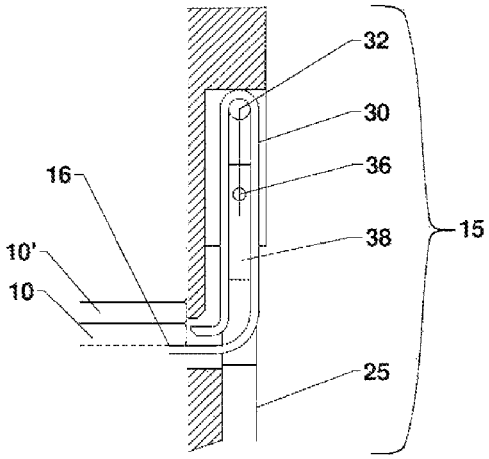
FIGS. 4*a* and 4*b* are expanded section views of the no touch dispenser escapement mechanism.
Figure 4B:
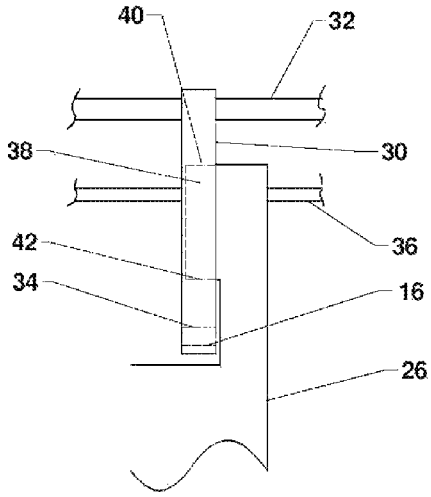
Figure 5:
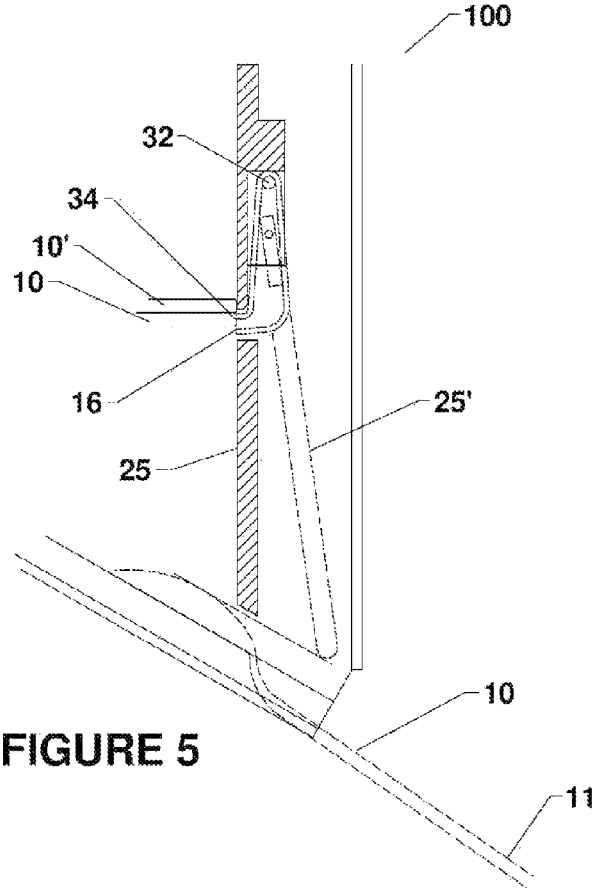
FIG. 5 is a detail section dispensing view of the no touch utensil dispenser.

Referring now to FIGS. 4, 4*a*, and 4*b*, there are shown detail views of escapement mechanism 15 in the rest position. The rest position is that at which the dispenser is at rest, between the actions of dispensing a utensil 10 and the cantilever action 17 that occurs during the automatic replenishment of the utensil 10. FIG. 4*b* is an end view that shows escapement actuator finger 26 in rest position 25. An escapement leaf spring 30 is mounted to an escapement spring axle 32 to allow the movement of escapement leaf spring 30 during the movement of escapement actuator finger 26 from rest position 25 to extended position 25' (FIG. 5). The escapement actuator finger 26 is held in place by an escapement actuator axle 36 that allows the pivoting motion between rest position 25 and extended position 25'. This motion, combined with an escapement actuator 38 being sandwiched between the two tines 16 and 34 of escapement leaf spring 30, creates an expansion of spring tines 16 and 34 that allow for the singular dispensing of a utensil 10 while retaining the next to last utensil 10'. The motion is best shown as the difference between FIGS. 4*a* and 5*a*.

Figure 5A:
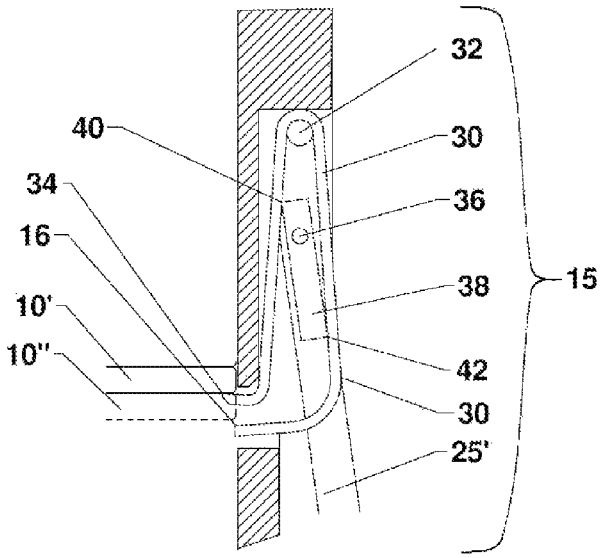
FIG. 5*a* is an expanded view of the no touch dispenser escapement mechanism.

Referring now to FIGS. 5 and 5*a*, there is shown a detailed view of escapement mechanism 15 in the extended position. The dispenser 100 is currently dispensing a utensil 10 by the cantilever action 17 that occurs during the automatic replenishment of the utensil 10. As mentioned hereinabove, FIG. 5*a* illustrates the point at which a utensil 10 has been deployed and a replenishment utensil has come to the fore. As escapement actuator 38 begins to rotate about its axle 36, the two escapement actuator corners 40 and 42 apply outward pressure on the two tines 16 and 34 of escapement leaf spring 30 to begin the process of singulation. Escapement spring hold protrusion 34 retains the inventory of stored utensils 10 inside dispenser 100 as each utensil 10 is dispensed.

The complete process for retrieving a utensil 10 and dispensing a replacement therefor is described below.

Figure 6:
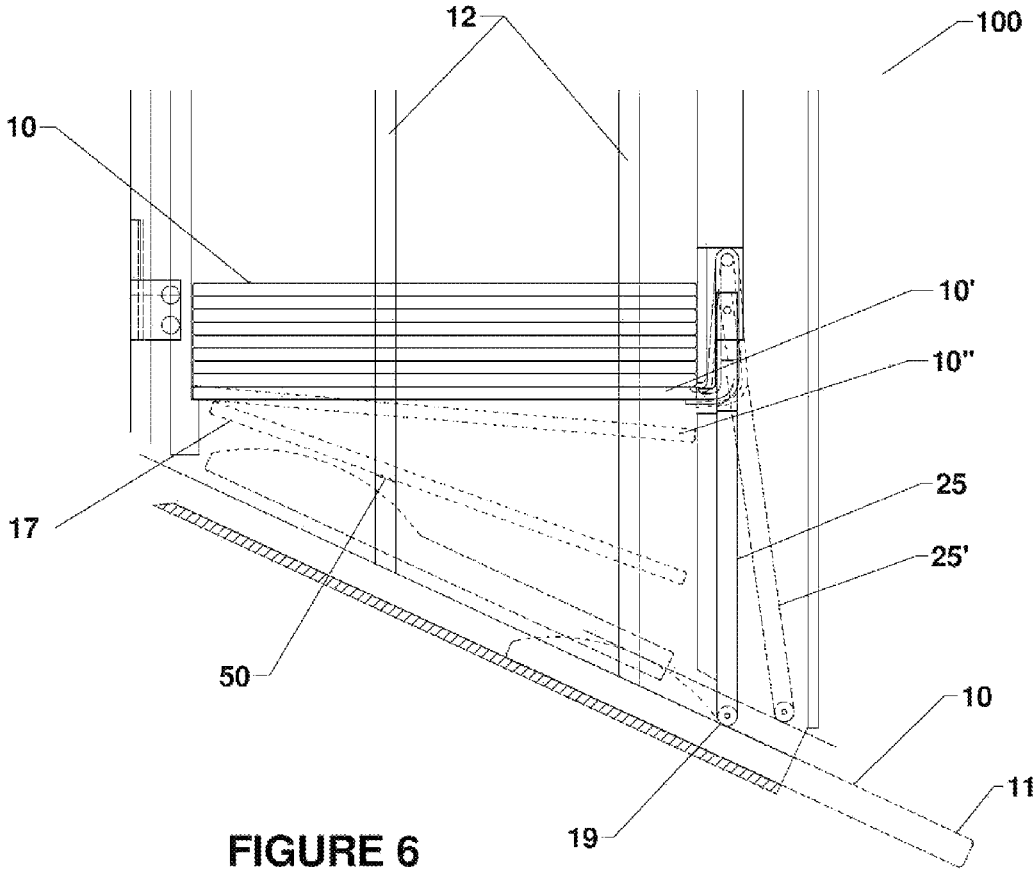
FIG. 6 is a detail view of a flat utensil dispenser.

Referring now to FIG. 6, there is shown a view of a dispenser 100 embodiment configured for dispensing flat utensils 10, such as knives. The process for dispensing described herein is substantially similar. For knives, the falling utensil 10 strikes a longitudinal ledge 50 during the cantilever action 17 to create a rotation that occurs during dispense. Such a rotation pivots the knife into a 90-degree longitudinal position to the exit area rest position 19 to keep the utensil 10 from prematurely exiting the dispenser 100.

Figure 7:
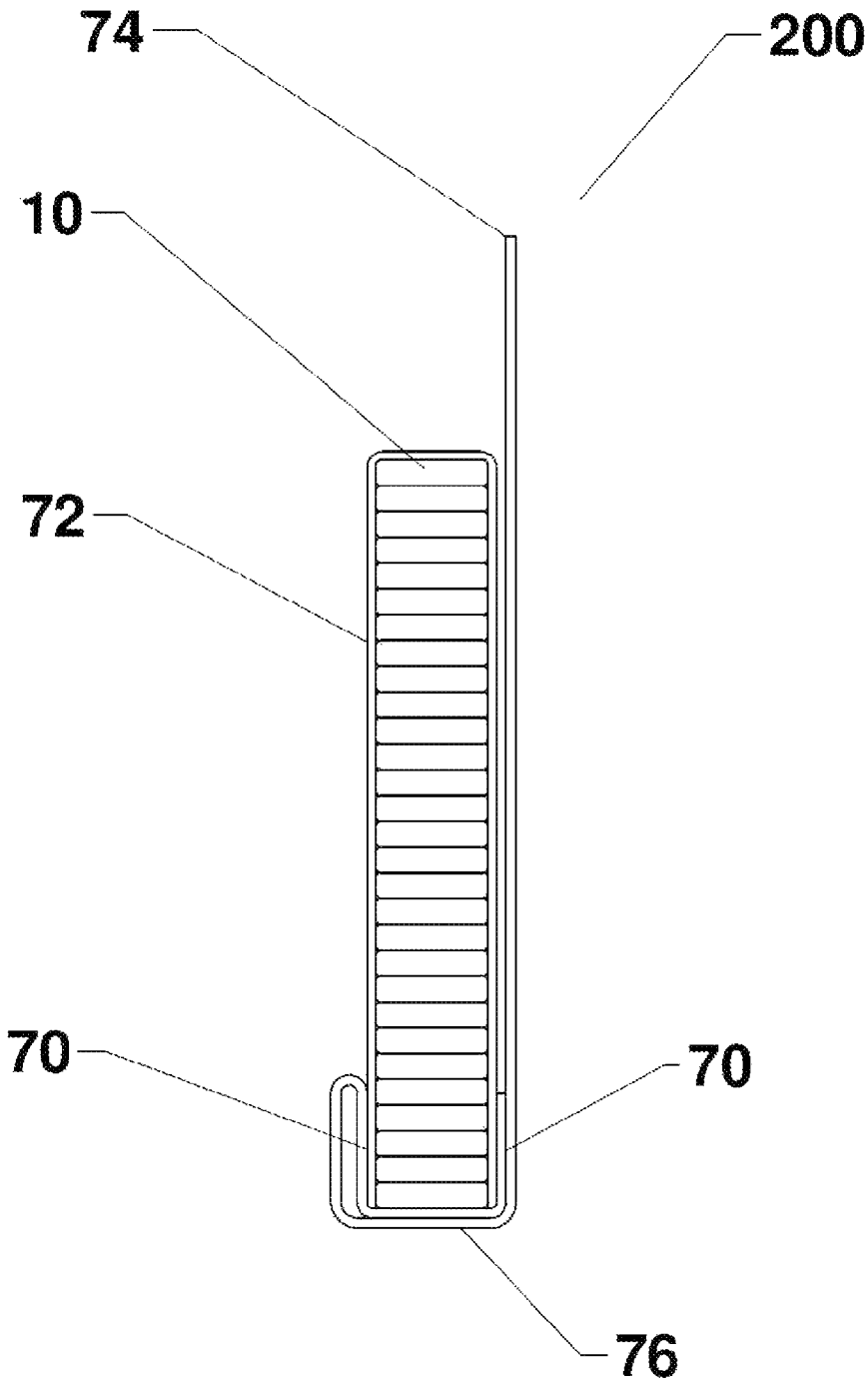
FIG. 7 is an end view of the no touch dispenser refill embodiment.

Referring now to FIG. 7, there is shown an end view of a bulk refill pack 200 of utensils 10. In this view, utensils 10 can be any utensil dispensable by dispenser 100. The bulk refill pack 200 consists of a stack of utensils 10 sheathed on three sides with a suitable material 72, such as cardboard. The bottom of the stack 76 is open except for a band of backing material 71 that retains the utensils in the bulk refill pack 200 by use of a limited, localized pressure sensitive adhesive 70 applied to backing material 71 to create a section of pressure sensitive tape 73 for concomitant containment and cleanliness used to retain the stack 76 in place. The method for deploying the bulk refill pack is described below.

The following is the sequence for dispensing a no touch spoon or fork utensil. The top 20 hinges open for filling the dispenser 100 with utensils 10. An operator loads the utensil bulk refill pack 200 while wearing rubber gloves, which is a normal item in the food industry. The utensils 10 are aligned by guides 12 along the Y-axis and the utensil container box 72 on the ends in the X-axis. The stack 76 of utensils 10 rests on two stops 14 and 16. Distal stop 14 is a ledge that is part of the back wall of dispenser 100 and the complementary side is the escapement release protrusion 16. Tab 74 of bulk refill pack 200 is pulled upwards on the utensil bulk refill pack 200. A pressure sensitive adhesive (PSA) tape 73 is peeled back on one side of the cardboard magazine container 72. After the tape 73 is peeled across the bottom of stack 76, the whole utensil stack 76 is released and the entire cardboard utensil container box 72 and tape 73 is removed vertically. A single utensil 10 is manually loaded into the exit area rest position 19. At this point, the dispenser 100 is ready for use.

The consumer then pulls on handle 11 of the utensil 10 in the exit area rest position 19. The escapement finger 26 rotates 25, 25' about a pivot pin 36. Two escapement finger corners 40, 42 push against the escapement leaf spring 30. The escapement spring hold protrusion 34 engages the bottom handle surface of the next to last utensil 10' to hold all but the last utensil in place. As the escapement finger corners 40, 42 continue to rotate, the escapement release protrusion 16 moves and releases only the bottom utensil handle 10". The bottom utensil handle 10" falls. The captured distal end 14 rotates, then releases 17 from the ledge 14. The handle 10" of the falling bottom utensil drops into a groove 27 in the bottom slide guide 29 and slides downward until the spoon or fork underside stops on escapement finger 26. Two flexible wires 24 act as guides for the handle if the consumer pulls the exiting utensil 10" too slowly.

The knife-only dispenser (FIG. 6) operates the same way as the spoon and fork dispenser (FIG. 2) but the knife goes through an extra motion to be ready for next dispense. Again, one knife 10 must be escaped or placed in the exit area rest position 19. The escapement leaf spring 30 both releases the lowermost knife and holds the magazine stack 76 above the lowermost knife 10'. The handle 10" starts to fall 17. As the constrained end of the knife is released from the ledge 14, the entire knife falls. A longitudinal ledge 50 on knife guide 12 restricts one side of the knife and the knife begins to pivot. The gaps of guide 12 are narrowed to keep the knife in a 90-degree longitudinal position as it falls. The lower edge of the knife drops into a groove 27 in the bottom slide guide 29. The knife slides until it is stopped in the exit area rest position 19 by the escapement finger 26. The escapement finger 26 may have a roller 31 on the bottom with teeth to match the knife serrations. Without the roller 31, the knife serrations may be deformed as knife 10 is pulled 11 out of the exit area rest position 19, making the knife a poor cutting utensil. The dispenser 100 is then ready to dispense the next knife.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An apparatus for dispensing utensils seriatim, comprising:

a) a housing for containing a plurality of longitudinal articles, said housing having a rear wall and a protrusion extending inwardly therefrom, and a front wall oppositely disposed thereto; and b) a leaf escapement mechanism comprising a first pivot operatively connected thereto and pivotably connected to said front wall, and extending inwardly therefrom, said leaf escapement mechanism comprising a leaf escapement finger and a second pivot operatively connected thereto for pivoting said escapement finger to actuate said leaf escapement mechanism.

2. The apparatus for dispensing utensils of claim 1, further comprising:

c) a side cover for containing said plurality of longitudinal articles.

3. The apparatus for dispensing utensils of claim 2, wherein said side cover is hingedly attached to said housing.

4. The apparatus for dispensing utensils of claim 1, wherein said protrusion is a guide rail and partial ledge for alignment of said longitudinal articles.

5. The apparatus for dispensing utensils of claim 1, wherein said front wall is adjustable towards and away from said rear wall.

6. The apparatus for dispensing utensils of claim 4, wherein said guide rail and said ledge are movable.

7. A method for dispensing utensils seriatim, the steps comprising:

a) loading a dispenser having a retaining ledge and guide means with utensils;

b) activating an escapement finger having corners and a stop;

c) rotating said escapement finger about pivot pin;

d) expanding ends of an escapement leaf spring having a hold protrusion and a release protrusion as said escapement finger rotates said corners of escapement finger;

e) moving said hold protrusion to engage a lower surface of a next-to-last said utensil to hold all but a last utensil in place;

f) moving said release protrusion and releasing a lower surface of a last utensil;

g) releasing said last utensil from said retaining ledge;

h) engaging a handle of the said released last utensil in a groove in a bottom slide guide; and i) allowing said utensil to slide downwardly until said utensil engages said stop.

8. The method for dispensing utensils of claim 7, further comprising:

j) employing guide wires for ensuring movement constraints of said article handle.

9. The method for dispensing utensils of claim 7, wherein said releasing step (g) further comprises orthogonally rotating said utensil.

10. The method for dispensing utensils of claim 9, wherein said orthogonally rotating step is performed for at least one of the following group: knife, flat utensil, and longitudinally constructed object.

* * * * *